US010529528B2

(12) United States Patent
Shimizu

(10) Patent No.: US 10,529,528 B2
(45) Date of Patent: Jan. 7, 2020

(54) X-RAY TUBE ASSEMBLY INCLUDING A FIRST CYLINDRICAL PIPE, A SECOND CYLINDRICAL PIPE, AND AN ELASTIC MEMBER

(71) Applicant: Canon Electron Tubes & Devices Co., Ltd., Otawara-shi (JP)

(72) Inventor: Katsunori Shimizu, Otawara (JP)

(73) Assignee: Canon Electron Tubes & Devices Co., Ltd., Otawara-shi (JP)

( * ) Notice: Subject to any disclaimer, the term of this patent is extended or adjusted under 35 U.S.C. 154(b) by 303 days.

(21) Appl. No.: 15/474,174

(22) Filed: Mar. 30, 2017

(65) Prior Publication Data

US 2017/0290135 A1 Oct. 5, 2017

(30) Foreign Application Priority Data

Apr. 1, 2016 (JP) ..... 2016-074402

(51) Int. Cl.
*H01J 35/02* (2006.01)
*H01J 35/06* (2006.01)
(Continued)

(52) U.S. Cl.
CPC ..... *H01J 35/12* (2013.01); *H01J 35/02* (2013.01); *H01J 35/06* (2013.01); *H01J 35/105* (2013.01);
(Continued)

(58) Field of Classification Search
CPC ..... H01J 35/02; H01J 35/025; H01J 35/06; H01J 35/08; H01J 35/105; H01J 35/106;
(Continued)

(56) References Cited

U.S. PATENT DOCUMENTS 3,870,916 A * 3/1975 Küssel ..... H01J 35/106 313/32
4,064,411 A * 12/1977 Iwasaki ..... H01J 35/12 313/39
(Continued)

FOREIGN PATENT DOCUMENTS

CN 101154550 A 4/2008
CN 103929670 A 7/2014
(Continued)

OTHER PUBLICATIONS

Combined Chinese Office Action and Search Report dated Jul. 5, 2018 in Chinese Patent Application No. 201710201856.9 (with English translation), citing documents AA, AO and AP therein, 13 pages.

*Primary Examiner* — Allen C. Ho
(74) *Attorney, Agent, or Firm* — Oblon, McClelland, Maier & Neustadt, L.L.P.

(57) ABSTRACT

According to one embodiment, an X-ray tube assembly includes a cathode, an anode target, a joint including an inflow part into which a coolant flows, a first cylindrical pipe to which the joint is connected at one end, and the anode target is joined at an outer bottom part of the other end, a second cylindrical pipe whose first end part is fitted into the inflow part, and whose second end part is arranged to eject the coolant toward the bottom part of the first cylindrical pipe, the second cylindrical pipe being placed inside the first cylindrical pipe and an elastic member provided between the first end part and the first cylindrical pipe.

9 Claims, 3 Drawing Sheets

(51) Int. Cl.
*H01J 35/08* (2006.01)
*H01J 35/12* (2006.01)
*H01J 35/16* (2006.01)
*H01J 35/10* (2006.01)
*H05G 1/02* (2006.01)

(52) U.S. Cl.
CPC ..... *H01J 35/106* (2013.01); *H01J 35/16* (2013.01); *H05G 1/025* (2013.01); *H01J 2235/12* (2013.01); *H01J 2235/1204* (2013.01)

(58) Field of Classification Search
CPC ..... H01J 35/12; H01J 35/16; H01J 2235/12; H01J 2235/1204
USPC ..... 378/130, 141, 199, 200
See application file for complete search history.

(56) References Cited

U.S. PATENT DOCUMENTS 4,264,818 A * 4/1981 Petersen ..... H01J 35/12 378/141
4,433,432 A * 2/1984 Nii ..... H01J 35/16 378/193
4,501,566 A * 2/1985 Carlson ..... H01J 35/101 277/629
4,573,186 A * 2/1986 Reinhold ..... H01J 35/14 378/136
4,674,109 A * 6/1987 Ono ..... H01J 35/10 378/123
4,878,235 A * 10/1989 Anderson ..... H01J 35/10 378/136
5,541,975 A * 7/1996 Anderson ..... H01J 35/106 378/130
5,579,364 A * 11/1996 Osaka ..... H01J 35/101 378/127
6,487,273 B1 * 11/2002 Takenaka ..... H01J 35/16 378/131
6,594,340 B2 * 7/2003 Saito ..... H01J 35/106 378/130
7,203,281 B2 * 4/2007 Smith ..... H01J 35/101 378/131
7,203,282 B2 * 4/2007 Brauss ..... B01D 29/03 378/141
7,206,380 B2 * 4/2007 Anno ..... H05G 1/04 378/130
7,236,570 B2 * 6/2007 Canfield ..... H05G 1/04 378/141
7,302,042 B2 * 11/2007 Hansen ..... H01J 35/16 378/130
7,349,525 B2 * 3/2008 Morton ..... H01J 35/08 378/124
7,391,852 B2 * 6/2008 Anno ..... H01J 35/105 378/125
7,508,916 B2 * 3/2009 Frontera ..... H01J 35/101 378/130
7,543,987 B2 * 6/2009 Canfield ..... A61B 6/40 378/141
7,558,376 B2 * 7/2009 Anno ..... H01J 35/103 378/125
7,688,949 B2 * 3/2010 Warburton ..... H01J 35/18 378/140
7,697,665 B2 * 4/2010 Yonezawa ..... H01J 35/106 378/130
8,036,341 B2 * 10/2011 Lee ..... H01J 35/08 378/143
8,054,945 B2 * 11/2011 Andrews ..... H01J 35/18 378/140
8,090,075 B2 * 1/2012 Holm ..... H01J 35/165 378/141
8,363,787 B2 * 1/2013 Lathrop ..... H01J 35/101 378/132
8,675,819 B2 * 3/2014 Astle ..... B22C 7/02 378/130
9,057,685 B2 * 6/2015 Allen ..... G01N 23/223
9,202,664 B2 * 12/2015 Wassom ..... H01J 35/106
9,234,855 B2 * 1/2016 Watanabe ..... G01N 23/04
9,251,994 B2 * 2/2016 Watanabe ..... H01J 35/12
9,263,225 B2 * 2/2016 Morton ..... H01J 35/08
9,263,226 B2 * 2/2016 Zhao ..... G01N 23/04
9,351,694 B2 * 5/2016 Anno ..... H05G 1/025
9,420,676 B2 * 8/2016 Chen ..... H05G 1/025
9,431,207 B2 * 8/2016 Imai ..... H01J 35/101
9,892,883 B2 * 2/2018 Anno ..... H01J 35/16
2005/0201520 A1 9/2005 Smith et al.

FOREIGN PATENT DOCUMENTS

JP 6-84490 3/1994
JP 2010-44897 2/2010
JP 2013-254652 12/2013

* cited by examiner

X-RAY TUBE ASSEMBLY INCLUDING A FIRST CYLINDRICAL PIPE, A SECOND CYLINDRICAL PIPE, AND AN ELASTIC MEMBER

CROSS-REFERENCE TO RELATED APPLICATIONS

This application is based upon and claims the benefit of priority from Japanese Patent Application No. 2016-074402, filed Apr. 1, 2016, the entire contents of which are incorporated herein by reference.

FIELD

Embodiments described herein relate generally to an X-ray tube assembly.

BACKGROUND

An X-ray tube assembly used for fluorescent X-ray analysis includes a cathode, anode target, cooling pipe, water conduit pipe, and jointing part (hereinafter, referred to as a joint) for joining the water conduit pipe and the cooling pipe to each other. The X-ray tube assembly is provided with a flow path of a coolant constituted of the cooling pipe, water conduit pipe, joint, and other structural members, the coolant being used to cool the anode target. The anode target is joined to a predetermined position on the outside of the structural member constituting the flow path. The water conduit pipe and the cooling pipe are respectively joined to the joint. The water conduit pipe is constituted of, for example, an inner pipe provided on the inside, and an outer pipe provided on the outside. A tip nozzle part of the inner pipe is arranged to eject the coolant in the direction to the position at which the anode target is placed. In this case, the cooling pipe is constituted of a first cooling pipe connected to the inner pipe through the joint, and a second cooling pipe connected to the outer pipe through the joint. In this X-ray tube assembly, the coolant is passed through the first cooling pipe, is sent to the inner pipe through the joint, is then passed through the flow path between the inner pipe and the outer pipe, and is discharged from the second cooling pipe through the joint.

In the X-ray tube assembly, electrons emitted from the cathode bombard the anode target, whereby the temperature of the anode target and a peripheral part thereof becomes high. The anode target and the peripheral part thereof are cooled with the coolant flowing through the flow path formed in their vicinities. On the wall surface inside a part of the flow path through which the coolant flows close to the position at which the anode target is placed, there is a possibility of subcooled boiling of the coolant or cavitation in the coolant flow occurring. Due to the subcooled boiling or cavitation, in the part of the flow path close to the position at which the anode target is placed, i.e., in the vicinity of the tip nozzle part of the inner pipe, bubbles form. Bubbles form at the periphery of the tip nozzle part of the inner pipe, and then the formed bubbles collapse (to generate a shockwave in the coolant), whereby the inner pipe can vibrate. When the fit clearance between the inner pipe and the joint is large, the vibration of the inner pipe becomes large, and furthermore there is a possibility of the noise becoming high.

As described above, due to the vibration incidental to collapse of the bubbles forming in the flow path because of the subcooled boiling, cavitation or the like, the water conduit pipe vibrates and comes into contact with the peripheral member, whereby there is a possibility of noise occurring.

The embodiment of the present invention has been contrived in consideration of these circumstances, and has it as an object thereof to provide an X-ray tube assembly having a structure configured to diminish vibration of the water conduit pipe in order to reduce noise.

DETAILED DESCRIPTION

In general, according to one embodiment, an X-ray tube assembly comprising: a cathode which emits electrons; an anode target from which X-rays are generated by being bombarded with the electrons emitted from the cathode; a joint including an inflow part into which a coolant flows; a closed-end first cylindrical pipe to which the joint is connected at one end, and the anode target is joined at an outer bottom part of the other end; a second cylindrical pipe whose first end part is fitted into the inflow part, and whose second end part is arranged to eject the coolant flowing into the pipe from the first end part toward the bottom part of the first cylindrical pipe, to which the anode target is joined, the second cylindrical pipe being placed inside the first cylindrical pipe; and an elastic member provided between the first end part and the first cylindrical pipe.

Hereinafter, an embodiment will be described with reference to the drawings.

(Embodiment)

Figure 1A:
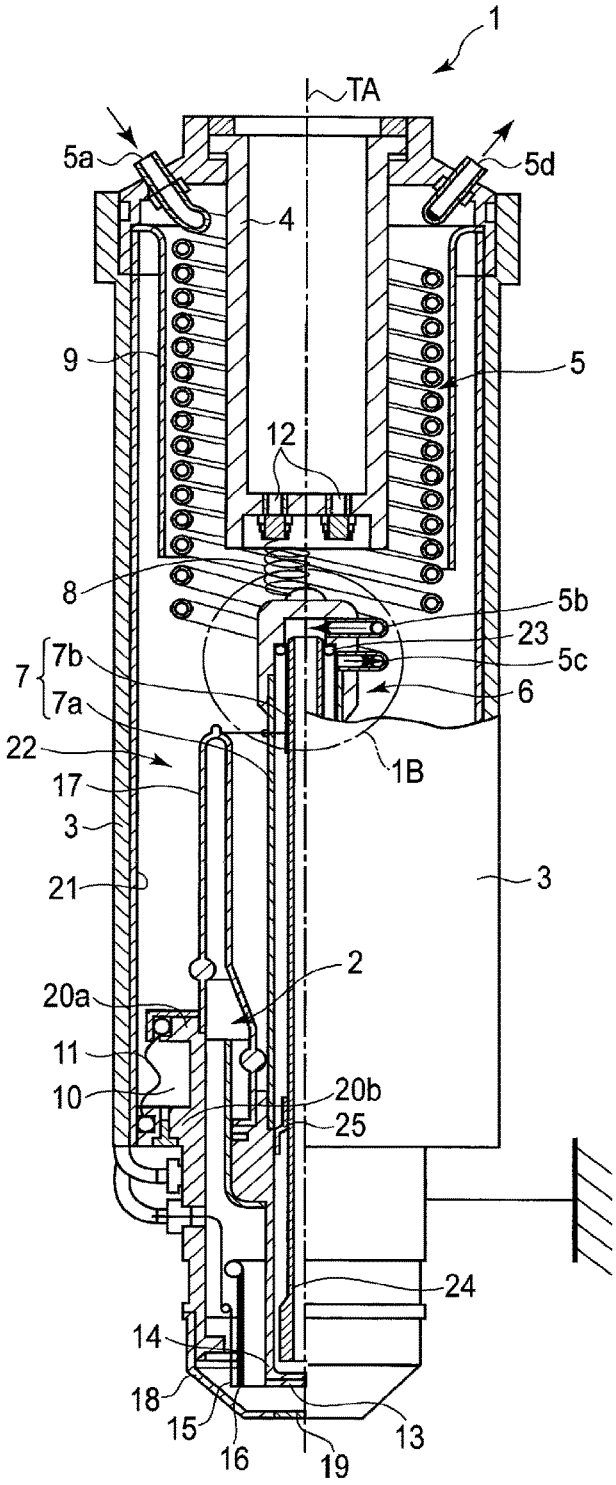
FIG. 1A is an overall cross-sectional view showing an example of an X-ray tube assembly according to an embodiment.
Figure 1B:
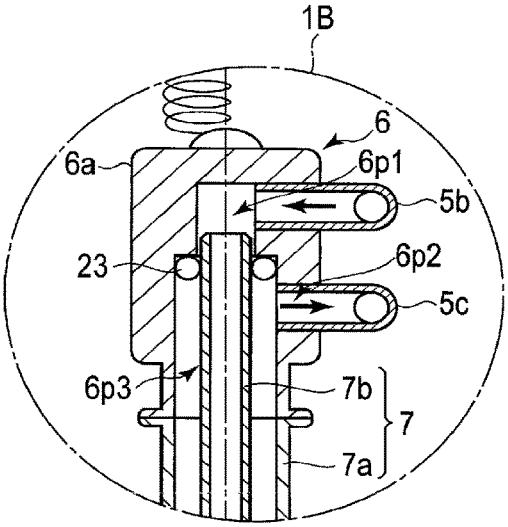
FIG. 1B is a partial cross-sectional view obtained by enlarging part of the X-ray tube assembly of the embodiment.

FIG. 1A is an overall cross-sectional view showing an example of an X-ray tube assembly 1 according to this embodiment, and FIG. 1B is a partial cross-sectional view obtained by enlarging part of the X-ray tube assembly 1 of this embodiment. In FIG. 1A, a cross section of part of the X-ray tube assembly 1 is shown with a tube axis TA taken as a center line. In the following description, a direction parallel to the tube axis TA is called the axial direction. In the axial direction, the side of the X-ray tube 2 is called the downward direction (lower side), and a direction opposite to the downward direction is called the upward direction (upper side). Further, a direction perpendicular to the tube axis TA is called the radial direction.

The X-ray tube assembly 1 is provided with an X-ray tube 2, and a tube housing 3 containing therein the X-ray tube 2. Furthermore, the X-ray tube assembly 1 is provided with a high-voltage receptacle 4 used to insert therein and connect thereto a high-voltage cable, cooling pipe 5, joint-connection part (hereinafter simply called a joint) 6, water conduit pipe 7, conductor spring 8 which electrically connects the high-voltage receptacle 4 and the water conduit pipe 7 to each other, insulating cylinder 9 having a cylindrical shape and provided on the outside of the high-voltage receptacle 4, and bellows 11 which separates a vacant tray 10 and the internal space 22 from each other.

The high-voltage receptacle 4 is opened at an upper end thereof and is formed into a closed-end cylindrical shape for connection of the high-voltage cable. The high-voltage receptacle 4 is provided on the upper side of the tube housing 3 to be described later in a liquid-tight state with the tube axis TA being the central axis thereof. The high-voltage receptacle 4 is provided with connection terminals 12 penetrating the bottom thereof from inside to the outer bottom part. Each of the connection terminals 12 includes a bushing for the external wiring to be inserted into the high-voltage receptacle 4 and a terminal. The connection terminals 12 are connected to the joint 6 through a conductor spring 8.

The insulating cylinder 9 is constituted of an insulator having a substantially cylindrical shape. The insulating cylinder 9 is made to have a structure through which insulating oil can circulate although not shown. The insulating cylinder 9 has, for example, an upper end part thereof fixed to the inside of the tube housing 3.

The cooling pipe 5 is a conduit pipe which makes a coolant, for example, pure water flow therethrough. The cooling pipe 5 is provided between the high-voltage receptacle 4 and the insulating cylinder 9 in a spiral form. The cooling pipe 5 is constituted of a first cooling pipe 5*b* provided with a feed-water inlet 5*a* through which the coolant is supplied, and a second cooling pipe 5*c* provided with an outlet 5*d* from which the coolant is discharged. In the first cooling pipe 5*b*, the feed-water inlet 5*a* is connected to a circulative cooling unit or the like (not shown) serving as a supply source of the coolant, and an end part thereof on the opposite side of the feed-water inlet 5*a* is connected to the joint 6. On the other hand, in the second cooling pipe 5*c*, the outlet 5*d* is connected to the circulative cooling unit or the like (not shown), and an end part thereof on the opposite side of the outlet 5*d* is connected to the joint 6. It should be noted that the cooling pipe 5 may not be provided in the form of a spiral.

The joint 6 is provided at the central part of the X-ray tube assembly 1, for example, on the tube axis TA, and connects the cooling pipe 5 and the water conduit pipe 7 to each other. The joint 6 includes a main body part 6*a* in which three holes including a first pathway 6*p*1, second pathway 6*p*2 formed substantially parallel to the first pathway 6*p*1, and third pathway 6*p*3 formed perpendicular to the first pathway 6*p*1 and the second pathway 6*p*2 are formed.

For example, as shown in FIG. 1B, the first pathway 6*p*1 is formed in the upper part of the main body part 6*a* substantially perpendicular to the tube axis TA to lead from the lateral face (outer periphery) to the third pathway 6*p*3. Likewise, the second pathway 6*p*2 is formed in the part of the main body part 6*a* lower than the first pathway 6*p*1 substantially perpendicular to the tube axis TA to lead from the lateral face to the third pathway 6*p*3. That is, each of the first and second pathways 6*p*1 and 6*p*2 is opened at the lateral face of the main body part 6*a* in a direction perpendicular to the tube axis TA. Further, to the first pathway 6*p*1, the first cooling pipe 5*b* is connected in a liquid-tight state, and to the second pathway 6*p*2, the second cooling pipe 5*c* is connected in a liquid-tight state. The third pathway 6*p*3 is formed along the tube axis TA to lead from the lower end part of the main body part 6*a* to the first pathway 6*p*1, and has a step extending from a position thereof communicating with the second pathway 6*p*2 to a position thereof communicating with the first pathway 6*p*1. That is, the third pathway 6*p*3 is opened downward along the tube axis TA, and is formed in such a manner that a hole diameter of the part thereof communicating with the first pathway 6*p*1 is smaller than a hole diameter of the part thereof communicating with the second pathway 6*p*2. In the following description, in the third pathway 6*p*3, the part thereof communicating with the first pathway 6*p*1 and having the smaller diameter is called a small-diameter part, and the part thereof communicating with the second pathway 6*p*2 and having the larger diameter is called a large-diameter part.

The water conduit pipe 7 includes an outer pipe (first cylindrical pipe) 7*a* formed into a cylindrical shape, and an inner pipe (second cylindrical pipe) 7*b* having a cylindrical shape and provided inside the outer pipe 7*a*. Further, the water conduit pipe 7 is internally provided with an elastic member 23, and a supporting member 25. The water conduit pipe (cylindrical pipe) 7 is provided to extend in the axial direction, for example, along the tube axis TA, and is connected to the lower part of the joint 6.

The outer pipe 7*a* is joined to each of the lower part of the main body part 6*a* of the joint 6, and the upper part of an anode block 14 to be described later in a liquid-tight state. The outer pipe 7*a* is formed in such a manner that the inner diameter thereof is substantially equal to the diameter of the large-diameter part of the third pathway 6*p*3.

The inner pipe 7*b* is formed in such a manner that the outer diameter thereof is smaller than the inner diameter of the outer pipe 7*a*. The inner pipe 7*b* is provided to extend inside the outer pipe 7*a* along the tube axis TA, an upper end part thereof is fitted into the small-diameter part of the third pathway 6*p*3, and an intermediate part thereof is supported by the supporting member 25, and a lower end part thereof is provided with a tip nozzle part 24. The inner pipe 7*b* has an outer diameter substantially equal to the hole diameter of the small-diameter part of the third pathway 6*p*3, and has a fit clearance with a predetermined tolerance between itself and the small-diameter part of the third pathway 6*p*3.

Figure 2A:
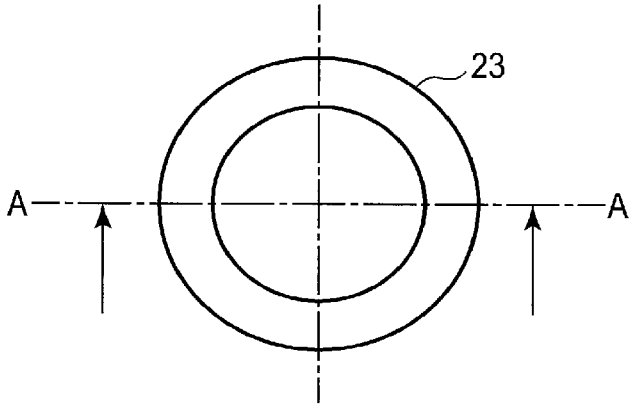
FIG. 2A is a top view showing an example of an elastic member.
Figure 2B:
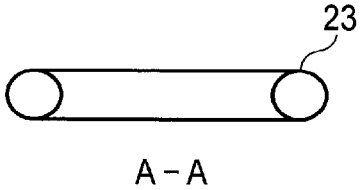
FIG. 2B is a cross-sectional view of the member whose cross section along line A-A of FIG. 2A is circular.
Figure 2C:
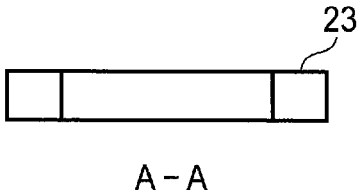
FIG. 2C is a cross-sectional view of the member whose cross section along line A-A of FIG. 2A is rectangular.

FIG. 2A is a top view showing an example of the elastic member 23, and FIG. 2B and FIG. 2C are cross-sectional views showing examples of the cross section along line A-A of FIG. 2A. FIG. 2B is a cross-sectional view of the member whose cross section along line A-A of FIG. 2A is circular, and FIG. 2C is a cross-sectional view of the member whose cross section along line A-A of FIG. 2A is rectangular.

The elastic member 23 is formed into, for example, an O-ring-like shape or a pipy shape. The cross-sectional shape of the elastic member 23 may be made circular as shown in FIG. 2B, or may be made rectangular as shown in FIG. 2C. The elastic member 23 is constituted of a resinous rubber member. It is sufficient if the elastic member 23 is formed of at least one of, for example, silicone rubber, fluoro-rubber, ethylene-propylene rubber, and nitrile rubber. As shown in FIG. 1B, the elastic member 23 is provided at the step part of the third pathway 6*p*3 and between the outer circumferential part of the inner pipe 7*b* close to the fit part of the inner pipe 7*b* and the large-diameter part of the third pathway 6*p*3. The thickness of the elastic member 23 is substantially equal to or greater than the gap between the outer circumferential surface of the inner pipe 7*b* and the inner circumferential surface of the large-diameter part of the third pathway 6*p*3. Further, it is sufficient if the elastic member 23 is provided at least at a part close to the fit part of the inner pipe 7*b* and between the inner pipe 7*b* and the third pathway 6*p*3.

Figure 3:
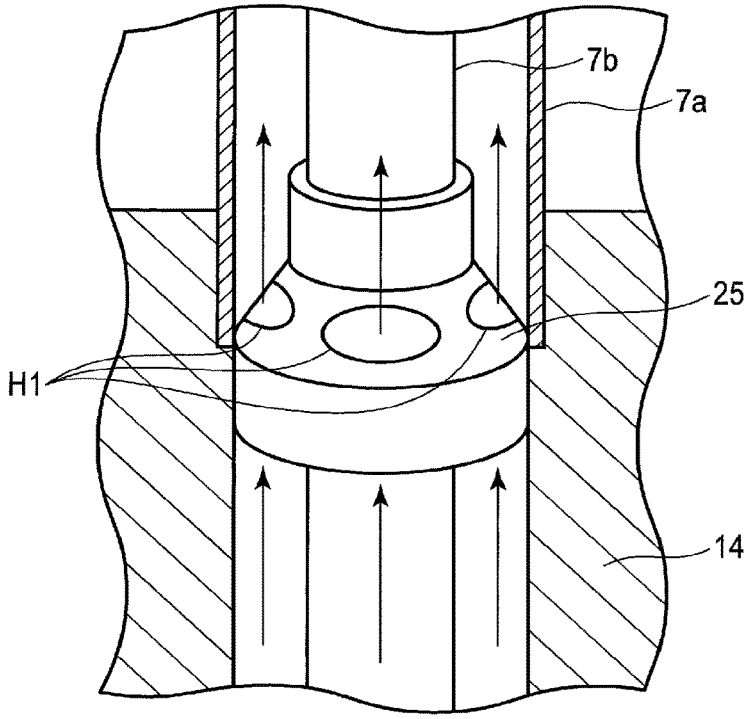
FIG. 3 is a partial cross-sectional view obtained by enlarging part of a supporting member of this embodiment.

FIG. 3 is a partial cross-sectional view obtained by enlarging a part of the supporting member 25 of this embodiment.

As shown in FIG. 3, the supporting member 25 is formed into a substantially circular truncated cone-like cylindrical shape including a small-width part and a large-width part having a larger width (diameter) than the small-width part. The supporting member 25 supports the inner pipe 7*b* inside the outer pipe 7*a*. In the supporting member 25, the large-width part thereof is fixed to the inner circumferential part of the outer pipe 7*a*, and the inner pipe 7*b* is fitted into the inner side of the small-width part thereof. In the supporting member 25, one or more holes H1 each of which is configured to pass the cooling water therethrough are formed at predetermined positions between the small-width part and the large-width part.

The X-ray tube 2 is provided with an anode target (anode) 13, anode block 14, cathode 15 which emits electrons, Wehnelt electrode 16, first vacuum envelope 17, and second vacuum envelope 18. When the high-voltage cable is connected to the high-voltage receptacle 4, a high voltage (tube voltage) is applied between the anode target 13 and the cathode 15 to be described later.

The anode block 14 is formed into a closed-end cylindrical shape having the tube axis TA as the central axis thereof. On the opening part side of the anode block 14, the lower end part of the outer pipe 7*a* is fixed. Inside the anode block 14, the tip nozzle part 24 of the inner pipe 7*b* is arranged. The cooling water is ejected from the tip nozzle part 24 toward the bottom part (or toward the position at which the anode target 13 is placed) inside the anode block 14.

In the X-ray tube assembly 1, the aforementioned joint 6, water conduit pipe 7, water conduit pipe 7, and anode block 14 are assembled, whereby a flow path configured to make the coolant flow therethrough is constituted. It should be noted that although each of the joint 6, water conduit pipe 7, and anode block 14 is described as a separate member, as long as the flow path configured to make the coolant flow therethrough is constituted, all the members may be formed integral with each other, or the members may be partially formed integral with each other. The coolant circulates through the flow path constituted of the cooling pipe 5, joint 6, water conduit pipe 7, and anode block 14, whereby insulating oil filled into the internal space 22 to be described later, anode target 13, and the like are cooled.

The anode target 13 is joined to the outer bottom part of the anode block 14. The anode target 13 generates X-rays by being bombarded with electrons. At this time, although the temperature of the anode target 13 is raised by being bombarded with electrons, the anode target 13 is cooled with the coolant flowing through the flow path arranged inside the anode block 14. A relatively positive tube voltage is applied to the anode target 13.

The cathode 15 is constituted of a ring-like filament, and is provided on the outside of the anode target 13 (or anode block 14) in the radial direction with a predetermined gap held between them. The cathode 15 is electrically grounded, and electrons emitted from the cathode 15 bombard the anode target 13 over the lower end part of the Wehnelt electrode 16 to be described later.

The Wehnelt electrode 16 is formed into a circular shape, and is provided between the anode target 13 and the cathode 15. The Wehnelt electrode 16 converges the electrons emitted from the cathode 15 to a point on the anode target 13.

The first vacuum envelope 17 is constituted of an inner cylinder, and outer cylinder. In the first vacuum envelope 17, upper end parts of the inner cylinder and the outer cylinder are joined to each other. Each of the inner cylinder and the outer cylinder has a substantially cylindrical shape, and is formed of, for example, a glass material or a ceramic material. In the first vacuum envelope 17, the lower end part of the inner cylinder is connected to the anode block 14 in a vacuum-tight state, and the lower end part of the outer cylinder is connected to the wall part of the x-ray tube 2 as part of the wall surface of the X-ray tube 2 in a vacuum-tight state.

The second vacuum envelope 18 is formed into a substantially cylindrical closed-end shape. In the second vacuum envelope 18, the upper end part thereof is connected to the wall part of the X-ray tube as part of the wall surface of the X-ray tube 2 in a vacuum-tight state. The second vacuum envelope 18 is electrically grounded together with the tube housing 3 to be described later. In the second vacuum envelope 18, an X-ray radiation window (window part) 19 is joined to an opening part penetrating the vicinity of the center of the bottom part in a vacuum-tight state. The X-ray radiation window 19 passes the X-rays generated from the anode target 13 when electrons bombard the anode target 13 therethrough to thereby radiate the X-rays to the outside of the X-ray tube assembly 1. The X-ray radiation window 19 is formed of a material passing X-rays, for example, a beryllium lamina. Further, the X-ray tube 2 is provided with a first salient part 20*a* and second salient part 20*b* each of which outwardly protrudes from part of the outer wall thereof.

The tube housing 3 is an airtight container configured to accommodate therein each part of the X-ray tube assembly 1. The tube housing 3 is formed into a substantially cylindrical shape having the tube axis TA as a central axis thereof. The tube housing 3 is constituted of, for example, a metallic member. Further, in the tube housing 3, the inner wall is lined with a lead plate 21. The internal space 22 inside the tube housing 3 (lead plate 21) is filled with insulating oil. Here, the internal space 22 is the space, for example, inside the tube housing 3, outside the X-ray tube 2 and the high-voltage receptacle 4, and other than the vacant tray 10 to be described later.

The bellows 11 is provided at a predetermined part on the lower side of the tube housing 3 to separate the internal space 22 and the vacant tray 10 from each other. In the bellows 11, one end part thereof is fixed to the first salient part 20*a*, and the other end part thereof is fixed to the second salient part 20*b*. The bellows 11 is constituted of a resinous elastic member, and expansion and contraction and the like of the insulating oil are absorbed by the expansion and contraction of inner volume in the vacant tray 10. The bellows 11 is, for example, a rubber member.

In this embodiment, in the X-ray tube assembly 1, the coolant is sent forth from the first cooling pipe 5*b*, and flows into the inner pipe 7*b* from the upper end part thereof through the first pathway 6*p*1. The coolant which has flowed into the inner pipe 7*b* is discharged from the tip nozzle part 24 of the inner pipe 7*b* toward the inner bottom part of the anode block 14 in the direction to the position at which the anode target 13 is placed. The coolant which has been discharged from the tip nozzle part 24 flows into the third pathway 6*p*3 of the joint 6 through a flow path constituted of the inner surface of the anode block 14 or the inner surface of the outer pipe 7*a* and the outer circumferential part of the inner pipe 7*b*. The coolant which has flowed into the third pathway 6*p*3 is ejected from the second cooling pipe 5*c* through the second pathway 6*p*2.

Further, in the X-ray tube assembly 1, when the high-voltage cable is connected to the high-voltage receptacle 4, a tube voltage is applied to the anode target 13. Further, electrons emitted from the cathode 15 bombard the anode target 13, whereby X-rays are generated. At this time, the anode target 13 is cooled with the coolant flowing through the flow path formed inside the anode block 14. In the coolant flowing through the flow path inside the anode block 14, bubbles form due to subcooled boiling or cavitation. The bubbles form and then collapse (to generate a shockwave in the coolant), whereby the inner pipe 7*b* vibrates. Furthermore, at the upper end part of the inner pipe 7*b*, there is a fit clearance between the inner pipe 7*b* and the first pathway 6*p*1, and hence the inner pipe 7*b* vibrates and can contact the wall surface of the first pathway 6*p*1. For this reason, noise can occur in the inner pipe 7*b*. In this embodiment, the elastic member 23 is provided on the upper end part of the inner pipe 7*b*, and hence even when the fit clearance between the end part of the inner pipe 7*b* and the first pathway 6*p*1 varies, vibration of the inner pipe 7*b* can be diminished.

Figure 4:
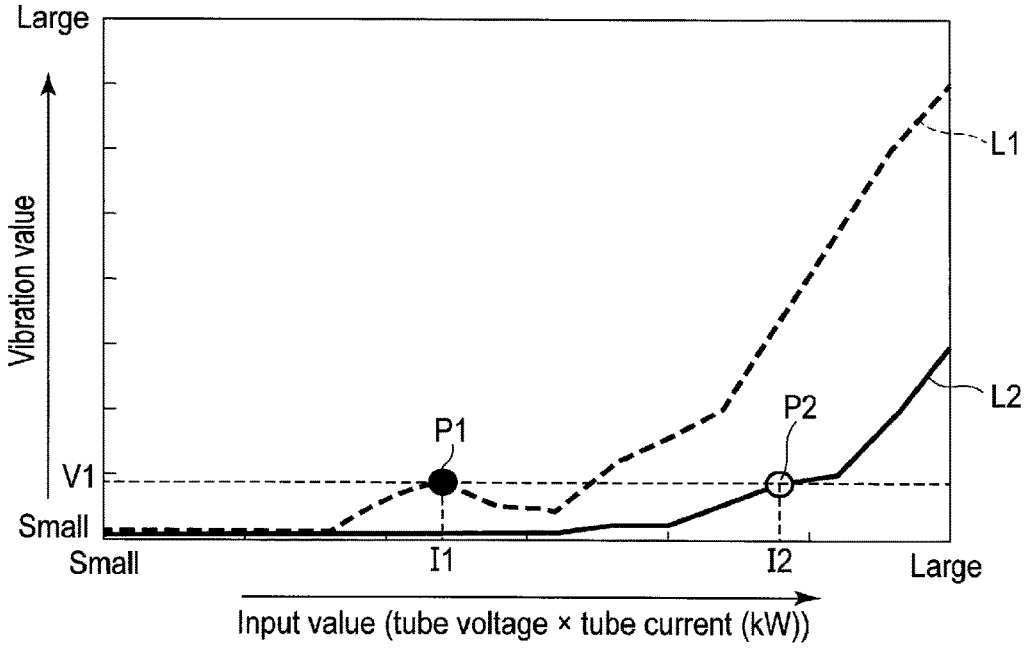
FIG. 4 is a view showing a relationship between the vibration value and input value of the X-ray tube assembly according to the embodiment.

FIG. 4 is a view showing a relationship between the vibration value and the input value of the X-ray tube assembly 1 according to this embodiment. FIG. 4 shows data obtained by the measure experiment of a vibration value for the input value in a simplified manner. In FIG. 4, the axis of ordinate indicates the vibration value, and the axis of abscissas indicates the input value. Here, the input value implies a value (kW) obtained by multiplying the tube voltage and the tube current together. On the axis of ordinate, it is shown that the vibration value becomes greater in the direction of the arrow. Further, on the axis of abscissas, it is shown that the input value becomes greater in the direction of the arrow.

In FIG. 4, as the input value to be input to the X-ray tube assembly 1 becomes greater, the amount of bubbles increases in the flow path in the vicinity of the inner bottom part of the anode block 14, and the vibration value of the water conduit pipe 7, for example, the inner pipe 7*b* becomes larger. In FIG. 4, L1 indicates a relationship (transition of a first vibration value) between the input value and the vibration value of a case where the elastic member 23 is not provided, and L2 indicates a relationship (transition of a second vibration value) between the input value and the vibration value of a case where the elastic member 23 is provided. Further, P1 indicates a predetermined point on L1, and P2 indicates a predetermined point on L2. At point P1, the vibration value corresponding to the input value I1 is V1, and at point P2, the vibration value corresponding to the input value I2 is V1. As shown in FIG. 4, the input value I2 is greater than the input value I1. For example, the input value I2 is a value twice the input value I1. Here, the vibration value V1 is, for example, a vibration value at which noise starts to occur.

From FIG. 4, the input value which becomes the basic point of the vibration value V1 corresponding to occurrence of noise is greater in the transition L2 of the second vibration value than in the transition L1 of the first vibration value. That is, in the case where the elastic member 23 is provided as in the X-ray tube assembly 1 of this embodiment, the vibration value can be restrained to a lower degree than the case where the elastic member 23 is not provided. As a result, occurrence of noise is reduced. Further, from an octave-band analysis result, particularly reduction in the sound pressure level of the high-frequency component of 2 kHz or higher has been confirmed.

According to this embodiment, in the X-ray tube assembly 1, the elastic member 23 is attached to the end part of the inner pipe 7*b* connected to the first pathway 6*p*1 of the joint 6 in order to absorb vibration. Thereby, in the X-ray tube assembly 1, even when the fit clearance between the end part of the inner pipe 7*b* and the first pathway 6*p*1 varies, vibration of the inner pipe 7*b* incidental to collapse of bubbles forming in the vicinity of the tip nozzle part 24 of the inner pipe 7*b* is diminished. As a result, noise of the X-ray tube assembly 1 can be reduced.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An X-ray tube assembly comprising:

a cathode which emits electrons;

an anode target from which X-rays are generated by being bombarded with the electrons emitted from the cathode;

a joint including an inflow part into which a coolant flows;

a closed-end first cylindrical pipe to which the joint is connected at one end, and the anode target is joined at an outside of a bottom part of the other end;

a second cylindrical pipe comprising a first end part fitted into the inflow part, and a second end part arranged to eject the coolant flowing into the closed-end first cylindrical pipe from the first end part toward the bottom part of the closed-end first cylindrical pipe, to which the anode target is joined, the second cylindrical pipe being placed inside the closed-end first cylindrical pipe; and an elastic member provided between the first end part and the closed-end first cylindrical pipe.

2. The X-ray tube assembly according to claim 1, wherein the elastic member is a resinous rubber member.

3. The X-ray tube assembly according to claim 2, wherein the elastic member is formed of at least one of silicone rubber, fluoro-rubber, ethylene-propylene rubber, and nitrile rubber.

4. The X-ray tube assembly according to claim 3, wherein the elastic member is formed into an O-ring-like shape or a pipy shape.

5. The X-ray tube assembly according to claim 3, wherein the elastic member is formed into a circular shape or a rectangular shape in cross section.

6. The X-ray tube assembly according to claim 2, wherein the elastic member is formed into an O-ring-like shape or a pipy shape.

7. The X-ray tube assembly according to claim 2, wherein the elastic member is formed into a circular shape or a rectangular shape in cross section.

8. The X-ray tube assembly according to claim 1, wherein the elastic member is formed into an O-ring-like shape or a pipy shape.

9. The X-ray tube assembly according to claim 1, wherein the elastic member is formed into a circular shape or a rectangular shape in cross section.

* * * * *